US008274436B2

(12) United States Patent
Huang

(10) Patent No.: US 8,274,436 B2
(45) Date of Patent: Sep. 25, 2012

(54) MULTI-BAND ANTENNA

(75) Inventor: Chih-Yung Huang, Taichung County (TW)

(73) Assignee: Arcadyan Technology Corp., Hsinchu (TW)

( * ) Notice: Subject to any disclaimer, the term of this patent is extended or adjusted under 35 U.S.C. 154(b) by 475 days.

(21) Appl. No.: 12/646,808

(22) Filed: Dec. 23, 2009

(65) Prior Publication Data

US 2010/0164821 A1 Jul. 1, 2010

(30) Foreign Application Priority Data

Dec. 26, 2008 (TW) ..... 97151132 A

(51) Int. Cl.
*H01Q 1/24* (2006.01)

(52) U.S. Cl. ..... 343/702; 343/700 MS; 343/846

(58) Field of Classification Search ..... 343/700 MS, 343/702, 846, 848
See application file for complete search history.

(56) References Cited

U.S. PATENT DOCUMENTS

| | | | | |
|---|---|---|---|---|
| 7,292,194 | B2 * | 11/2007 | Tai et al. | 343/702 |
| 7,474,267 | B2 * | 1/2009 | Chen et al. | 343/702 |
| 7,498,992 | B2 * | 3/2009 | Hung et al. | 343/702 |
| 7,839,337 | B2 * | 11/2010 | Hung et al. | 343/700 MS |
| 7,868,831 | B2 * | 1/2011 | Hung et al. | 343/700 MS |

* cited by examiner

*Primary Examiner* — Tan Ho

(57) ABSTRACT

A multi-band antenna is provided. The multi-band antenna includes a grounding element, a connecting element, a first radiating element and a second radiating element. The connecting element is connected to the grounding element and extends along a second direction. The first radiating element is connected to the connecting element and extends along the first direction, wherein the first radiating element, the grounding element and the connecting element are disposed on a first plane and have a resonating slot thereamong. The second radiating element is connected to the first radiating element and extends along a second plane to reach a specific distance, and then turns to be extended on a third plane parallel to the first plane, wherein the first plane and the third plane have a resonating region therebetween.

20 Claims, 7 Drawing Sheets

1

MULTI-BAND ANTENNA

FIELD OF THE INVENTION

The present invention relates generally to an antenna and, in particular to a combination of a planar inverted-F antenna (PIFA) and a slot antenna which is capable of operation in multi-frequency bands.

BACKGROUND OF THE INVENTION

In recent years, wireless communication devices, such as cellular phones, notebook computers and the like are more popular with the development of science and technology. The antennas with simple structure have become increasingly popular, especially ones which operate based on the principle of inverted-F antennas.

The evolution of communications technology results in various different communication standards and bandwidths. Typically, different antennas are correspondent to different standards and frequency bandwidths so that there exist diverse standards that are not only incompatible but also inconsistent to each other, which is accordingly inconvenient to manufacturers, system suppliers and consumers. The foregoing communication standards are widely used in the present day includes, such as Advance Mobile Phone System (AMPS), Global System for Mobile Communications (GSM), Distributed Control System (DCS), Personal Communications Service (PCS), Worldwide Interoperability for Microwave Access (WiMAX), IEEE 802.11a, etc.

If the communication standards could be integrated in one antenna, the inconvenience can be adequately solved and eliminated and the competitiveness for an antenna can be thus enhanced. Accordingly, an antenna can solve the above problems, and has simplified structure and a wider bandwidth is urgently demanded.

Therefore, it is tried to rectify those drawbacks and provide an antenna that has a simpler structure and is more adjustable for matching impedance to integrate four bandwidths. The present invention provides a multi-band antenna in order to achieve the foresaid objective.

Therefore, it is tried to rectify those drawbacks and provide an antenna that has a simpler structure and is more adjustable for matching impedance to have a wider bandwidth. The present invention provides a dual band antenna in order to achieve the foresaid objective.

SUMMARY OF THE INVENTION

In accordance with one respect of the present invention, a multi-band antenna is provided. The multi-band antenna includes a grounding element, a connecting element, a first radiating element and a second radiating element. The connecting element is connected to the grounding element and extends along a second direction. The first radiating element is connected to the connecting element and extends along the first direction, wherein the first radiating element, the grounding element and the connecting element are disposed on a first plane and have a resonating slot thereamong. The second radiating element is connected to the first radiating element and extends along a second plane to reach a specific distance, and then turns to be extended on a third plane parallel to the first plane, wherein the first plane and the third plane have a resonating region therebetween.

Preferably, the grounding element further includes a first protrusion, the connecting element and the first protrusion have a concave therebetween, and the first radiating element and the first protrusion have a slot therebetween.

Preferably, the first radiating element and the connecting element have a concave therebetween.

Preferably, the resonating slot has a T-like shape.

Preferably, the first radiating element has a signal feeding part extending toward the grounding element.

Preferably, the second radiating element further includes a connecting part connected to the first radiating element and extending toward the grounding element.

Preferably, the first radiating element further includes a turning part having a U-like shape.

Preferably, the second radiating element further includes a meandering part formed by a plurality of U-like parts and a protrusion extending toward the resonating region.

Preferably, the grounding element further includes a protrusion extending toward the resonating region.

In accordance with the aforementioned of the present invention, a multi-band antenna is provided. The multi-band antenna includes a first radiating element, a second radiating element, a grounding element, a connecting element. The grounding element extends along a first direction. The connecting element is connected to the grounding element. The first radiating element extends along the first direction, wherein the grounding element, the connecting element and the first radiating element are disposed on a first plane. The second radiating element is connected to the first radiating element and has a turning part extending along a second plane to a specific distance and then turns to be extended along a third plane, wherein the first plane and the third plane have a resonating region therebetween.

Preferably, the multi-band antenna further includes a signal feeding line having an outer conductor and an inner conductor, wherein the outer conductor is electrically connected to the grounding element.

Preferably, the multi-band antenna further includes a signal feeding line having an outer conductor and an inner conductor, wherein the first radiating element has a signal feeding part extending toward the grounding element and connected to the inner conductor.

Preferably, the grounding element further includes a first protrusion and the connecting element and the first protrusion have a first concave therebetween.

Preferably, the resonating slot has a T-like shape.

Preferably, the second radiating element further includes a connecting part connected to the first radiating element.

Preferably, the first radiating element further includes a turning part having a U-like shape.

Preferably, the second radiating element further includes a meandering part having a plurality of U-like parts and a second protrusion extending toward the resonating region.

In accordance with the aforementioned of the present invention, a multi-band antenna is provided. The multi-band antenna includes a plane unit and a second radiating element. The plane unit is disposed on a first plane and including a grounding element, a first radiating element and a connecting element connecting the grounding element and the first radiating element. The second radiating element is disposed and extends on a third plane until reaching a specific distance, and then turns to a second plane and contacted to the plane unit, wherein the first plane and the third plane have a resonating region therebetween.

Preferably, the multi-band antenna further includes a connecting part connecting the plane unit and the second radiating element, wherein the first plane is parallel to the third plane, and the grounding element and the first radiating element have a T-shaped resonating slot therebetween.

BRIEF DESCRIPTION OF THE DRAWING

The foregoing and other features and advantages of the present invention will be more clearly understood through the following descriptions with reference to the drawings, wherein.

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
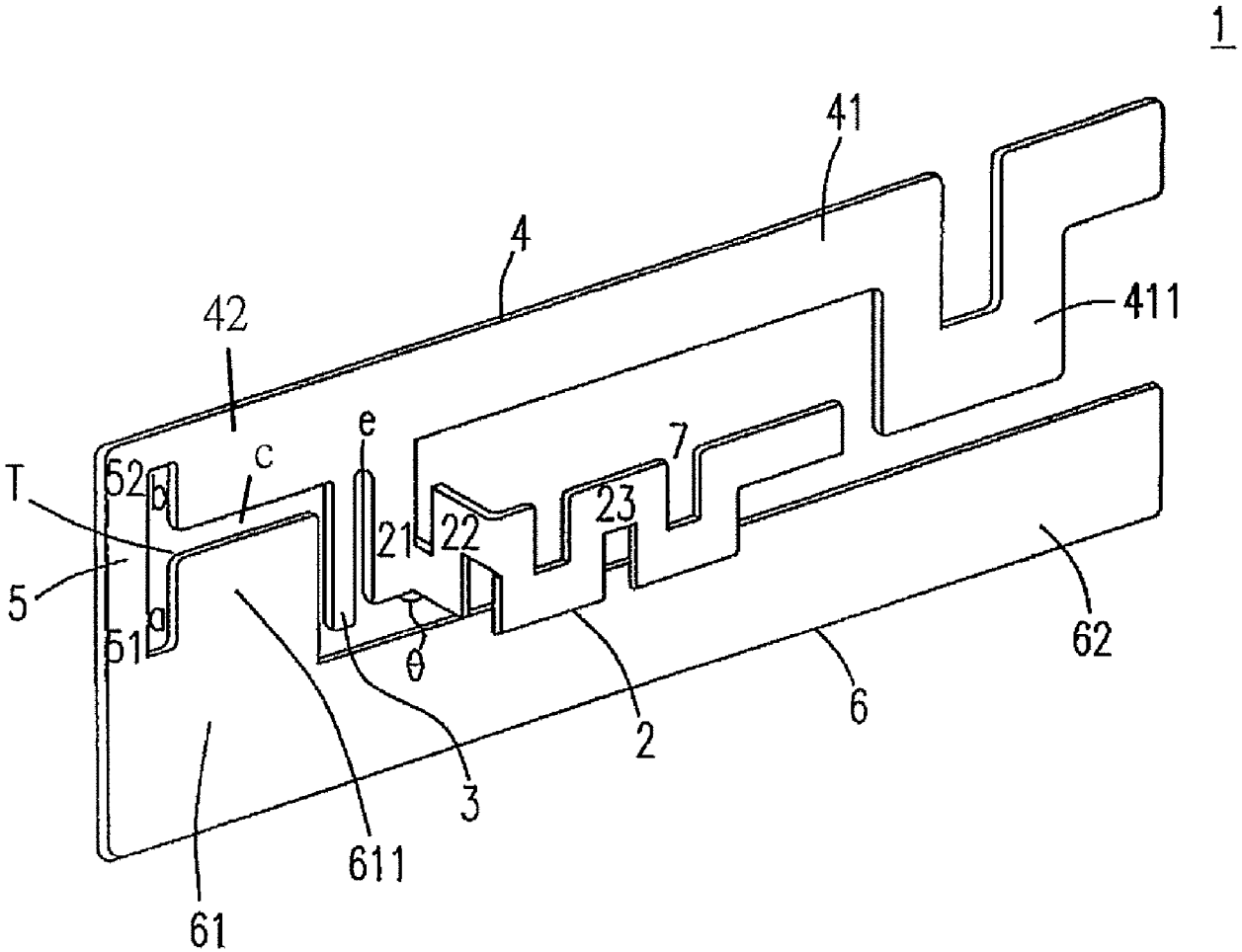
FIG. 1 is a top view of a multi-band antenna according to a first embodiment of the present invention.

Please refer to FIG. 1, which is a top view of a multi-band antenna according to a first embodiment of the present invention. As shown in FIG. 1, the multi-band antenna 1 includes a first radiating element 4, a second radiating element 2, a connecting element 5 and a grounding element 6. All these elements are integrated with a strip conductor and are made from conductive materials, such as iron, copper, etc. The first radiating element 4, the connecting element 5 and the grounding element 6 are disposed on a same plane and integrated into a plane unit. The grounding element 6 includes a first grounding part 61, a second grounding part 62 and a first protrusion 611. The second grounding part 62 is connected to the first grounding part 61 and extends in a first direction. The first protrusion 611 is connected to the first grounding part 61 and is electrically connected to an outer conductor of a signal feeding line (not shown).

As shown in FIG. 1, the first protrusion 611 is formed into a rectangle, but is not limited. The length, size and shape of the first protrusion 611 are based on the bandwidth of antenna and matching impedance.

Figure 2:
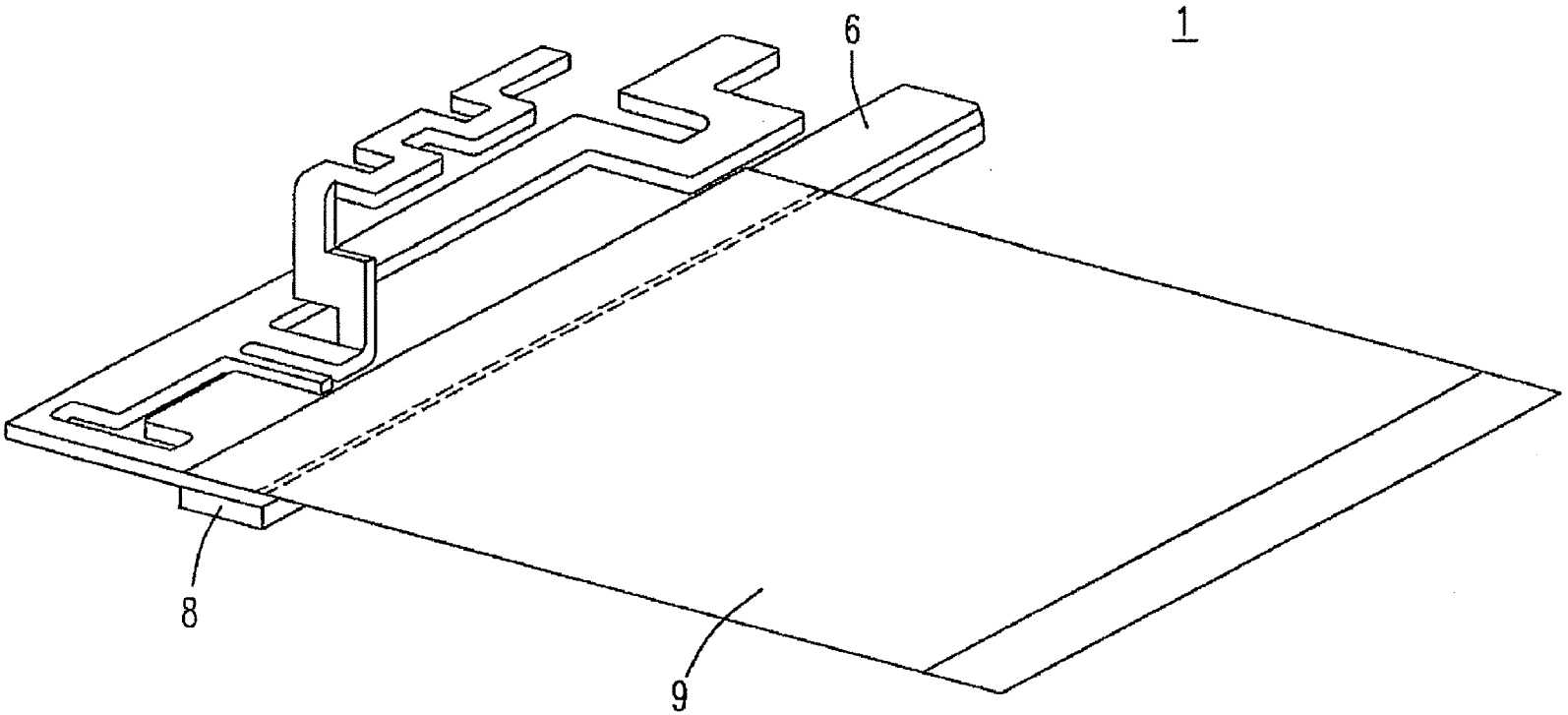
FIG. 2 is a side view of the multi-band antenna according to a second embodiment of the present invention.

Please refer to FIG. 2, which is a side view of the multi-band antenna 1 according to a second embodiment of the present invention. As shown in FIG. 2, a grounding foil 9 is disposed on the grounding element 6 so that the grounding element 6 is connected to a grounding structure so that the antenna 1 is applied more flexibly. Moreover, an adhesive foam 8 disposed on the grounding element 6 is used to fix the antenna 1 on other connected products, such as notebook computer, cell phone, etc.

Please refer to FIG. 1, the connecting element 5 of the multi-band antenna 1 has a first end 51 and a second end 52. The first end 51 of the connecting element 5 is connected to the first grounding part 61. The connecting element 5 extends from the first end 51 to the second end 52 in a second direction. The second direction is perpendicular to the first direction, preferably. The first end 51 and the first protrusion 611 form a first concave a. The second end 52 is connected to the first radiating element 4.

The first radiating element 4 had a first end 41 and a second end 42. The first end 41 extends from the second end 42 in the first direction. The first end 41 of the first radiating element 4 further has a turning part 411. The turning part 411 has a U-like shape for matching impedance of the first radiating element 4. The number of the U-like shape may increase for matching impedance, preferably. The connecting element 5 has a first end 51 and a second end 52. The second end 42 is connected to the second end 52 of the connecting element 5.

The second end 42 of the first radiating element 4 and the second end 52 of the connecting element 5 have a second concave b. The second end 42 and the first protrusion 611 have a first slot c. The second end 42 further includes a signal feeding part 3 near the first protrusion 611. The signal feeding part 3 extends in suitable length in the second direction to the grounding element 6 and is electrically connected to an inner conductor of the signal feeding line (not shown). A combination of the first concave a, the second concave b and the first slot c is a resonating slot T and has a T-like shape, preferably.

The size and length of the first radiating element 4 is adjustable for working in the relatively lower bandwidth (f1) ranging from 800 to 1000 MHz (for AMPS/GSM), preferably. It is noticed that the bandwidth of the resonating slot T is adjustable according to the width of the first concave a, the second concave b and the first slot c. Thus, the resonating slot T works in the relatively higher bandwidth (f4) ranging from 4700 to 6000 MHz (for IEEE 802.11a).

Figure 3:
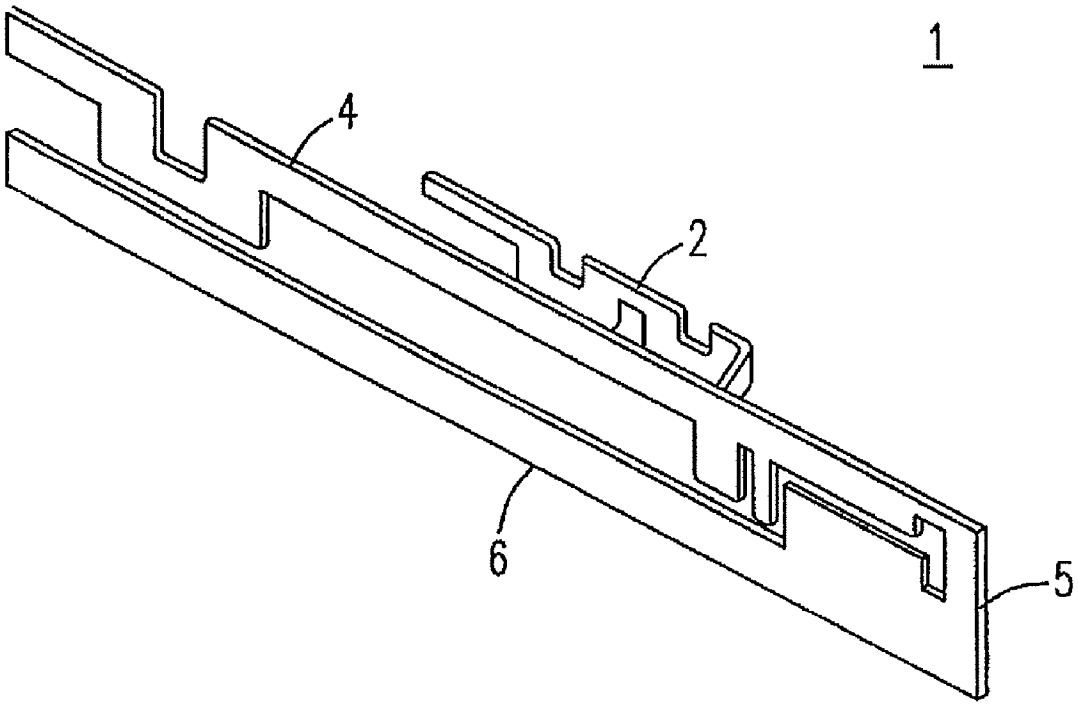
FIG. 3 is a bottom view of the multi-band antenna according to the first embodiment of the present invention.

Please refer to FIG. 3, which is a bottom view of the multi-band antenna 1 according to the first embodiment of the present invention. As shown in FIG. 3, the second radiating element 2 and the other elements of the multi-band antenna 1 is not on the same plane.

Please return to FIG. 1, the second radiating element 2 is connected to the first radiating element 4. The second radiating element 2 has two turns and divides into three parts. The second radiating element 2 has a connecting part 21, a turning part 22 and an extending part 23. The connecting part 21 is connected to the first radiating element 4 and extends along the second direction in appropriate distance, preferably. The connecting part 21, the first radiating element 4 and signal feeding part 3 have a second slot e thereamong, preferably. The width of the second slot e is adjustable for matching impedance.

The turning part 22 is connected to the connecting part 21 and extends along a second plane to appropriate distance. And then turns to be extended along a third plane to form the extending part 23 which extends along the first direction. The connecting part 21 and the turning part 22 have an angle θ which is 90 degree, preferably. The extending part 23 is parallel to the first plane, preferably. The connecting part 21 is on the first plane different from the turning part 22 and the extending part 23.

The second radiating element 2 further includes a meandering part having a plurality of U-like parts. The extending part 23 and the turning part 22 are integrated into the meandering part preferably. The distance (length) and size of the connecting part 21, the turning part 22 and the extending part 23 are adjustable for matching impedance and the second radiating element 2 works in a relatively lower bandwidth (f2) ranging from 1760 to 1960 MHz (for DCS/PCS). Moreover, the second radiating element 2, the first radiating element 4, the grounding element 6 have a resonating region 7 thereamong. The resonating region 7 is adjustable for matching impedance and works in a relatively higher bandwidth (f3) ranging from 3200 to 3600 MHz (for WiMAX).

Figure 4:
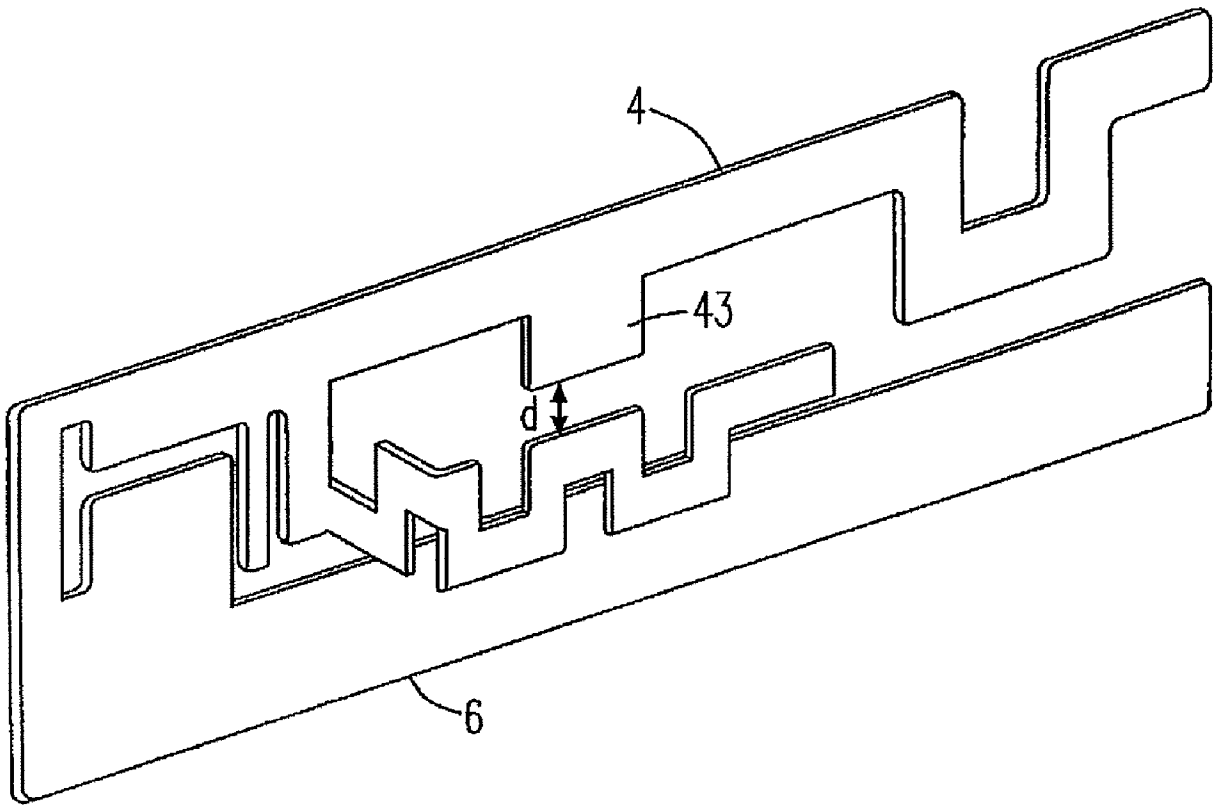
FIG. 4 is a top view of the multi-band antenna according to a third embodiment of the present invention.

Please refer to FIG. 4, which is a top view of the multi-band antenna 1 according to a third embodiment of the present invention. As shown in FIG. 4, the first radiating element 4 has a second protrusion 43 extending toward the resonating region 7. The second protrusion 43 and the grounding element 6 have a resonating distance d therebetween. If the resonating distance d is shorter, the frequency of the resonating region 7 becomes lower. It is noticed that the second protrusion 43 can be used to adjust the bandwidth of the resonating region 7. According to the same reason, a protrusion is disposed on the second grounding element 62. If the resonating distance d changes, the frequency band of the resonating region 7 is adjustable.

Figure 7:
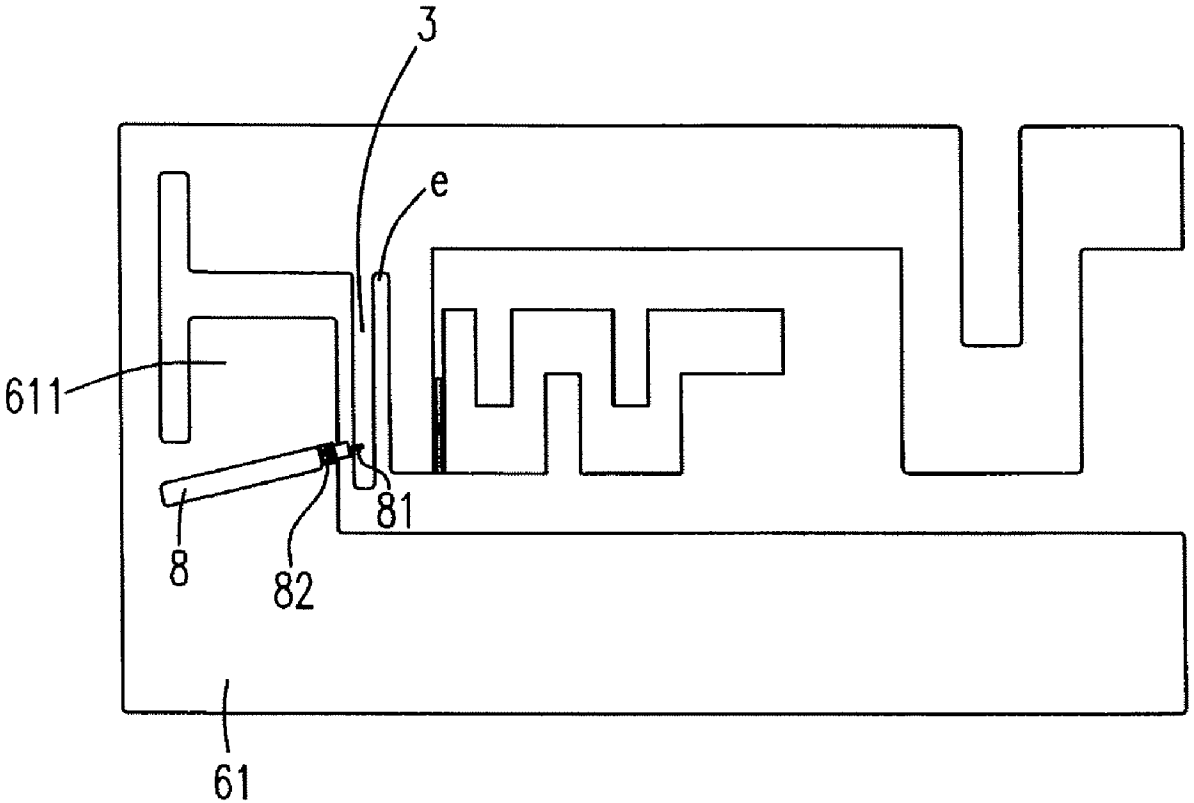
FIG. 7 is a top view of the multi-band antenna with the signal feeding line according to the first embodiment of the present invention.

Please refer to FIG. 7, which is a top view of the multi-band antenna 1 with the signal feeding line 8 according to the first embodiment of the present invention. As shown in FIG. 7, the signal feeding line 8 electrically connected to the multi-band antenna 1 is a coaxial cable having the inner core 81 conductor electrically connected to the signal feeding part 3 and the outer conductor 82 electrically connected to the first protrusion 611.

Figure 5:
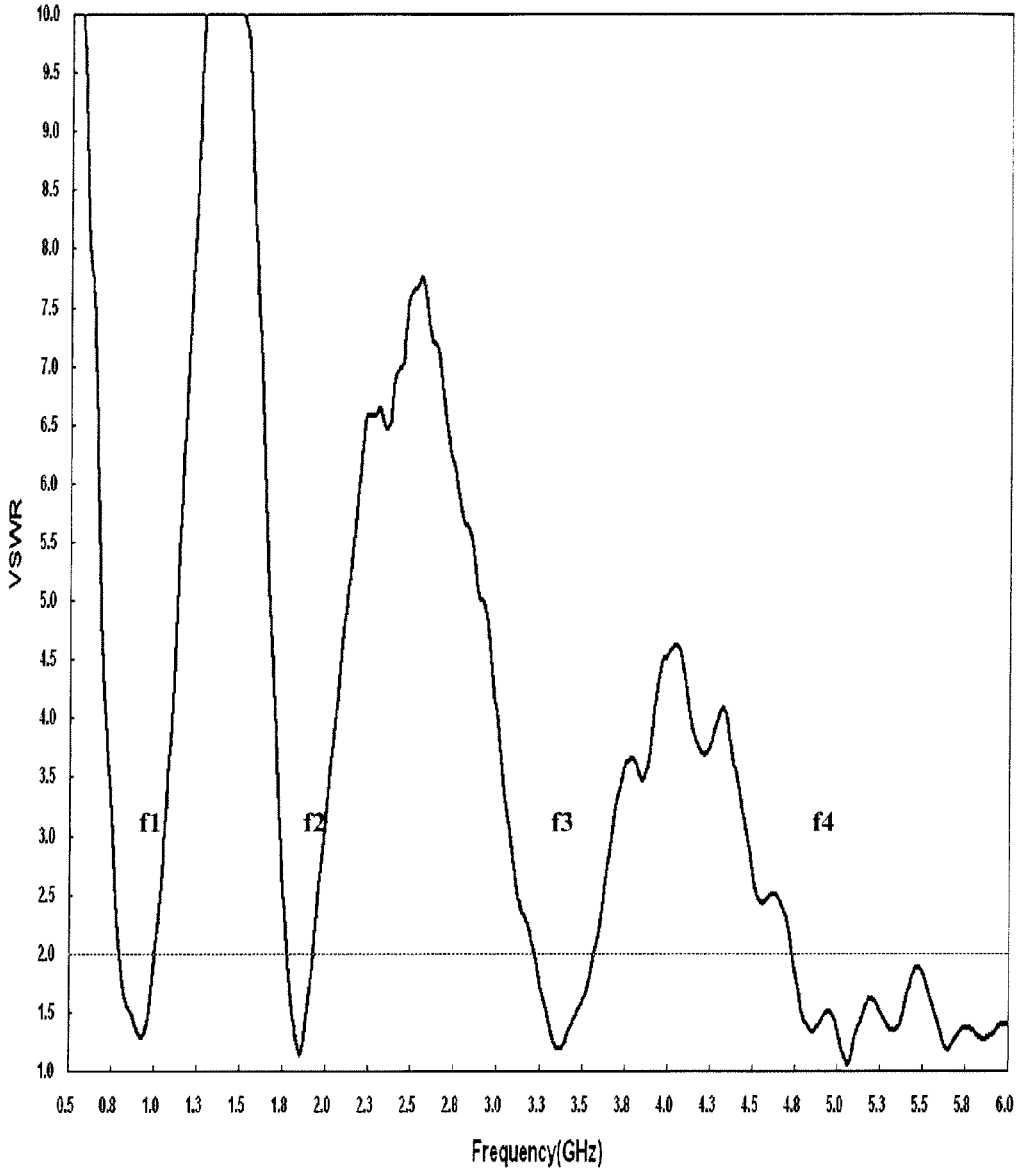
FIG. 5 is a waveform test chart for the multi-band antenna about voltage standing wave ratio (VSWR) as a function of frequency according to the first embodiment of the present invention.
Figure 6:
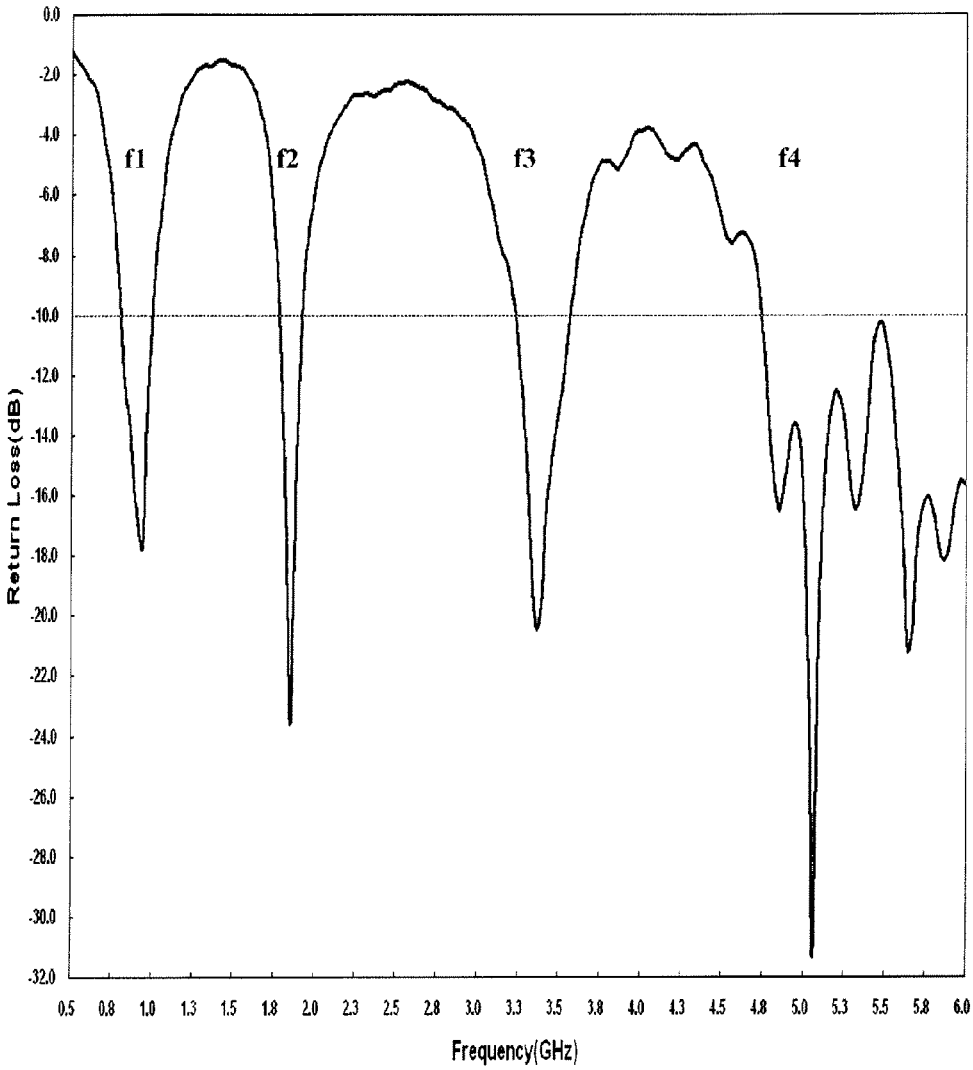
FIG. 6 is a waveform test chart for the multi-band antenna about return loss as a function of frequency according to the first embodiment of the present invention.

Please refer to FIG. 5, which is a waveform test chart for the multi-band antenna 1 about voltage standing wave ratio (VSWR) as a function of frequency according to the first embodiment of the present invention. As shown in FIG. 5, the VSWR values respectively corresponding to the four bandwidth of the multi-band antenna 1 are less than 2 and even less than 1.5. Please refer to FIG. 6, which is a waveform test chart for the multi-band antenna 1 about return loss as a function of frequency according to the first embodiment of the present invention. As shown in FIG. 6, the return loss values respectively corresponding to the four bandwidth of the multi-band antenna 1 are less than −10.0 db. It is obvious that the present invention can perform ideally.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claim is:

1. A multi-band antenna, comprising:

a grounding element extending along a first direction;

a connecting element connected to the grounding element and extending along a second direction;

a first radiating element connected to the connecting element and extending along the first direction, wherein the first radiating element, the grounding element and the connecting element are disposed on a first plane and have a resonating slot thereamong; and a second radiating element connected to the first radiating element, extending along a second plane to reach a specific distance and then turning to be extended on a third plane parallel to the first plane, wherein the first plane and the third plane have a resonating region there between.

2. The multi-band antenna according to claim 1, wherein the grounding element further comprises a first protrusion, the connecting element and the first protrusion have a concave there between, and the first radiating element and the first protrusion have a slot there between.

3. The multi-band antenna according to claim 1, wherein the first radiating element and the connecting element have a concave there between.

4. The multi-band antenna according to claim 1, wherein the resonating slot has a T-like shape.

5. The multi-band antenna according to claim 1, wherein the first radiating element has a signal feeding part extending toward the grounding element.

6. The multi-band antenna according to claim 1, wherein the second radiating element further comprises a connecting part connected to the first radiating element and extending toward the grounding element.

7. The multi-band antenna according to claim 1, wherein the first radiating element further comprises a turning part having a U-like shape.

8. The multi-band antenna according to claim 1, wherein the second radiating element further comprises a meandering part formed by a plurality of U-like parts and a protrusion extending toward the resonating region.

9. The multi-band antenna according to claim 1, wherein the grounding element further comprises a protrusion extending toward the resonating region.

10. A multi-band antenna, comprising:

a grounding element extending along a first direction;

a connecting element connected to the grounding element;

a first radiating element extending along the first direction, wherein the grounding element, the connecting element and the first radiating element are disposed on a first plane; and a second radiating element connected to the first radiating element and having a turning part extending along a second plane to a specific distance and then turning to be extended along a third plane, wherein the first plane and the third plane have a resonating region there between.

11. The multi-band antenna according to claim 10 further comprising a signal feeding line having an outer conductor and an inner conductor, wherein the outer conductor is electrically connected to the grounding element.

12. The multi-band antenna according to claim 10 further comprising a signal feeding line having an outer conductor and an inner conductor, wherein the first radiating element has a signal feeding part extending toward the grounding element and connected to the inner conductor.

13. The multi-band antenna according to claim 10, wherein the grounding element further comprises a first protrusion and the connecting element and the first protrusion have a first concave there between.

14. The multi-band antenna according to claim 10, wherein the resonating slot has a T-like shape.

15. The multi-band antenna according to claim 10, wherein the second radiating element further comprises a connecting part connected to the first radiating element.

16. The multi-band antenna according to claim 10, wherein the first radiating element further comprises a turning part having a U-like shape.

17. The multi-band antenna according to claim 10, wherein the second radiating element further comprises a meandering part having a plurality of U-like parts and a second protrusion extending toward the resonating region.

18. A multi-band antenna, comprising:

a plane unit disposed on a first plane and including a grounding element, a first radiating element and a connecting element connecting the grounding element and the first radiating element; and a second radiating element disposed and extending on a third plane until reaching a specific distance, and then turning to a second plane and contacted to the plane unit, wherein the first plane and the third plane have a resonating region there between.

19. The multi-band antenna according to claim 18 further comprising a connecting part connecting the plane unit and the second radiating element, wherein the first plane is parallel to the third plane, and the grounding element and the first radiating element have a T-shaped resonating slot therebetween.

20. The multi-band antenna according to claim 18, wherein the plane unit and the second radiating element are integrated with a strip conductor.

* * * * *